United States Patent [19]

Marchetti

[11] 4,218,862

[45] Aug. 26, 1980

[54] MACHINE FOR CLOSING THE UPPER FLAPS OF A PARALLELEPIPED BOX

[76] Inventor: Augusto Marchetti, Piazza Sicilia 7, Milan, Italy

[21] Appl. No.: 6,133

[22] Filed: Jan. 24, 1979

[30] Foreign Application Priority Data

Feb. 17, 1978 [IT] Italy ..... 20372 A/78
Feb. 22, 1978 [IT] Italy ..... 20510 A/78

[51] Int. Cl.[3] ..... B65B 7/20
[52] U.S. Cl. ..... 53/374
[58] Field of Search ..... 53/374, 375

[56] References Cited

U.S. PATENT DOCUMENTS 2,268,423 12/1941 Rose ..... 53/374 X
3,267,640 8/1966 Romney et al. ..... 53/374 X

*Primary Examiner*—Travis S. McGehee
*Attorney, Agent, or Firm*—Karl W. Flocks

[57] ABSTRACT

This invention relates to a machine for closing the upper flaps of a parallelepiped box. According to the invention the machine comprises a first closure member for the front flap of the box and a second closure member for the rear flap, said members being carried by a rotatable support in such a way that, when the support is in a first angular position, the first closure member is inserted in the path of the box to engage and close the front flap thereof and, when the support is in a second angular position, the second closure member is driven to engage and close the rear flap of the box.

4 Claims, 16 Drawing Figures

MACHINE FOR CLOSING THE UPPER FLAPS OF A PARALLELEPIPED BOX

This invention relates to a machine for closing the upper flaps of a parallelepiped box.

A parallelepiped box of the type comprising overturnable upper flaps arrives at the exit of the filling station with all the flaps open, and is then fed in this state into a closing machine in which suitable devices firstly close the front and rear end flaps, and then the side flaps.

The object of the present invention is to provide a machine for closing the upper flaps of a parallelepiped box, which comprises new and advantageous means for closing the end flaps.

This object is attained according to the invention by a machine of the type comprising a support surface for the boxes, means for feeding the boxes along said support surface, and, disposed above said support surface, a first closure member for momentarily engaging with the front end flap of the boxes to turn it over into its closed position, a second closure member for momentarily engaging with the rear end flap of the boxes to turn it over into its closed position, and a guide situated at a predetermined height above said support surface to engage with said overturned box flaps and retain them in their closed position after their disengagement from said closure members, wherein said first and second closure member are constituted by arms carried by respective front and rear ends of a rotatable support, which is rotatable on command from a first angular position for closing the front flap, to a second angular position for closing the rear flap, whereby in said first position said first closure member is inserted into the path of travel of the open end flaps of the boxes so that it is encountered by said front flap and is thus turned over into its closed position, said second closure member being outside said path, in said second position said first closure member is outside said path and said second closure member is inserted into said path to engage the open rear flap of the boxes from behind, means being provided to respond to the displacement of said rotatable support from said first to said second angular position to cause said second closure member to rotate relative to said rotatable support, on termination of said displacement, until in a substantially horizontal position for turning said rear flap over into its closed position.

In other words, the present invention has the advantageous characteristic of providing for the two end flap closure members a single, simple and small rotatable support, which by means of a single control, in association with suitable response means (preferably constituted by a chain which straddles the rotatable support, substantially in the form of an inverted V, to connect the second closure member to a fixed connection point), is able to move between two angular positions which automatically correspond to the respective operation of the two closure members which are connected thereto. This therefore combines simples structure with simple and effective operation in a device which represents a brilliant and advantageous solution to the problems related to closure of the upper end flaps of normal parallelepiped boxes of cardboard or a like flexible material.

However, from certain experimental tests carried out on a prototype machine according to the invention, a problem has arisen related to the position of the side flaps, the solution to which has proved necessary so as not to risk compromising the proper operation of the closure members for the end flaps.

This problem consists of the fact that after the front flap has been closed and before the rear flash is closed, the side flaps of the box can be induced for various reasons (for example by colliding against articulated rods which notably connect belt conveyors for feeding the boxes to lateral guides for the subsequent overturning of the side flaps) to incline slightly inwards, and thus cause an obstacle to the subsequent overturning of the rear flap for its closure.

According to a preferred embodiment of the invention, this problem is, however, solved by an improvement in which from the front flap closure member there extend two rigid side arms which diverge in an adjustable manner in the feed direction of the boxes, and are disposed at such a height as to engage the lateral flaps of the box from the inside, so as to retain it in at least a partly divaricated state until the moment in which the operation of the closure member for the rear flap has compelled this latter to incline towards the inside of the box, by passing beyond its vertical position.

It is apparent that the two added side arms provide a solution to the problem of positioning the side flaps at the moment in which the rear flap is overturned for closing, in that immediately after the closure of the front flap and thus before the side flaps are possibly caused to incline inwards, they become inserted between said side flaps (the divergent arrangement of which provides a lead-in), so holding them divaricated by the amount necessary to allow correct closure of the rear flap. As the rotation of the front flap closure member continues, said side arms leave the zone of engagement with said side flaps, so allowing them to be subsequently closed by the relative lateral guides.

The characteristics and advantages of the present invention will be more apparent from the detailed description given hereinafter of two possible embodiments, shown by way of example on the accompanying drawings, in which.

Figure 1:
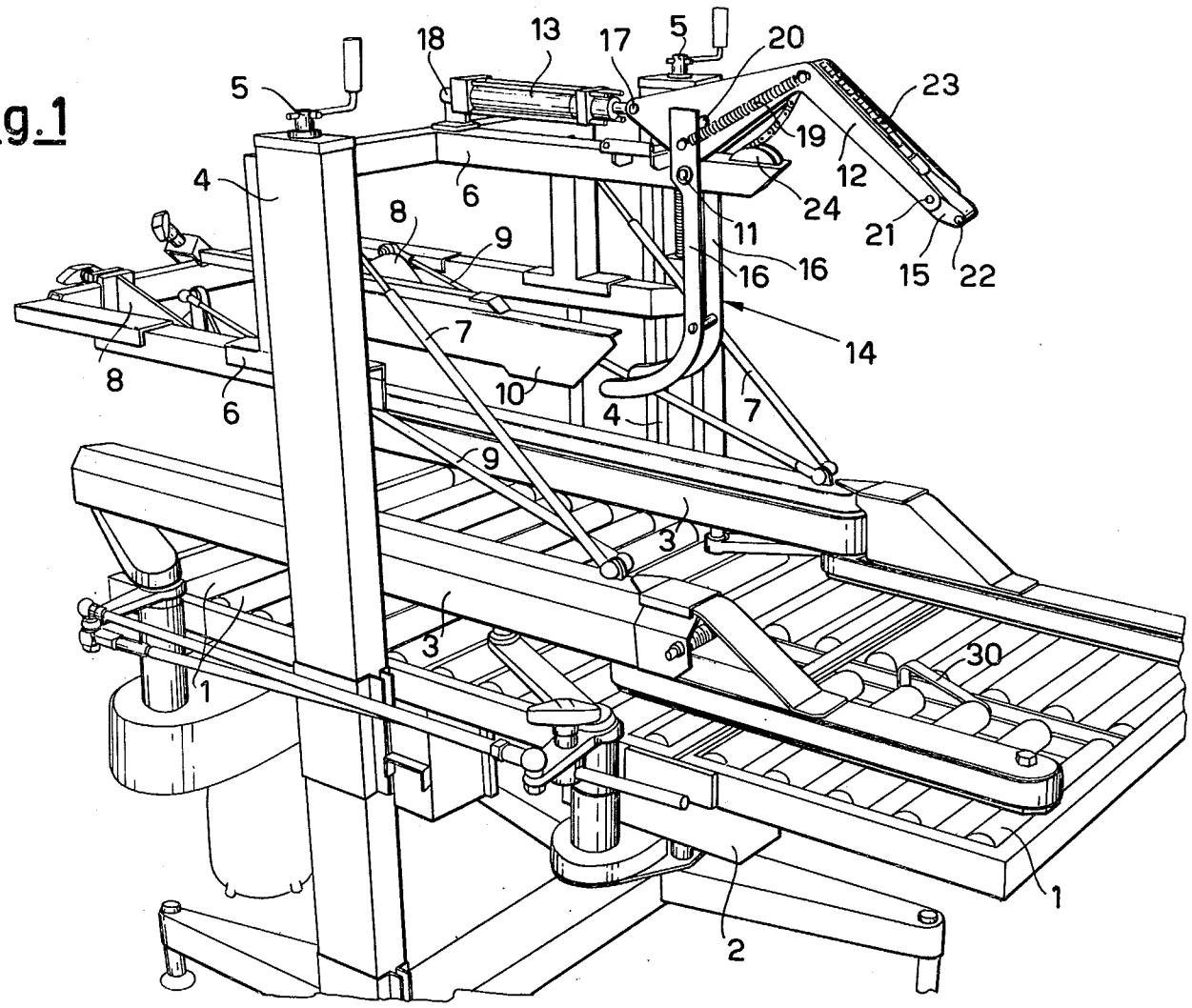
FIG. 1 is an overall perspective view of a machine for closing the upper flaps of a parallelepiped box, incorporating the characteristics of the present invention.

The machine shown in FIGS. 1 to 4, and in particular in FIG. 1, comprises a support and feed surface for the boxes, defined by a succession of idle rollers 1 supported by a base framework 2. At the two sides of said support surface there are two conveyor belt units 3, which can be disposed at an adjustable distance apart by known means, so as to allow them to engage the sides of the boxes for continuously feeding these latter.

Figure 2:
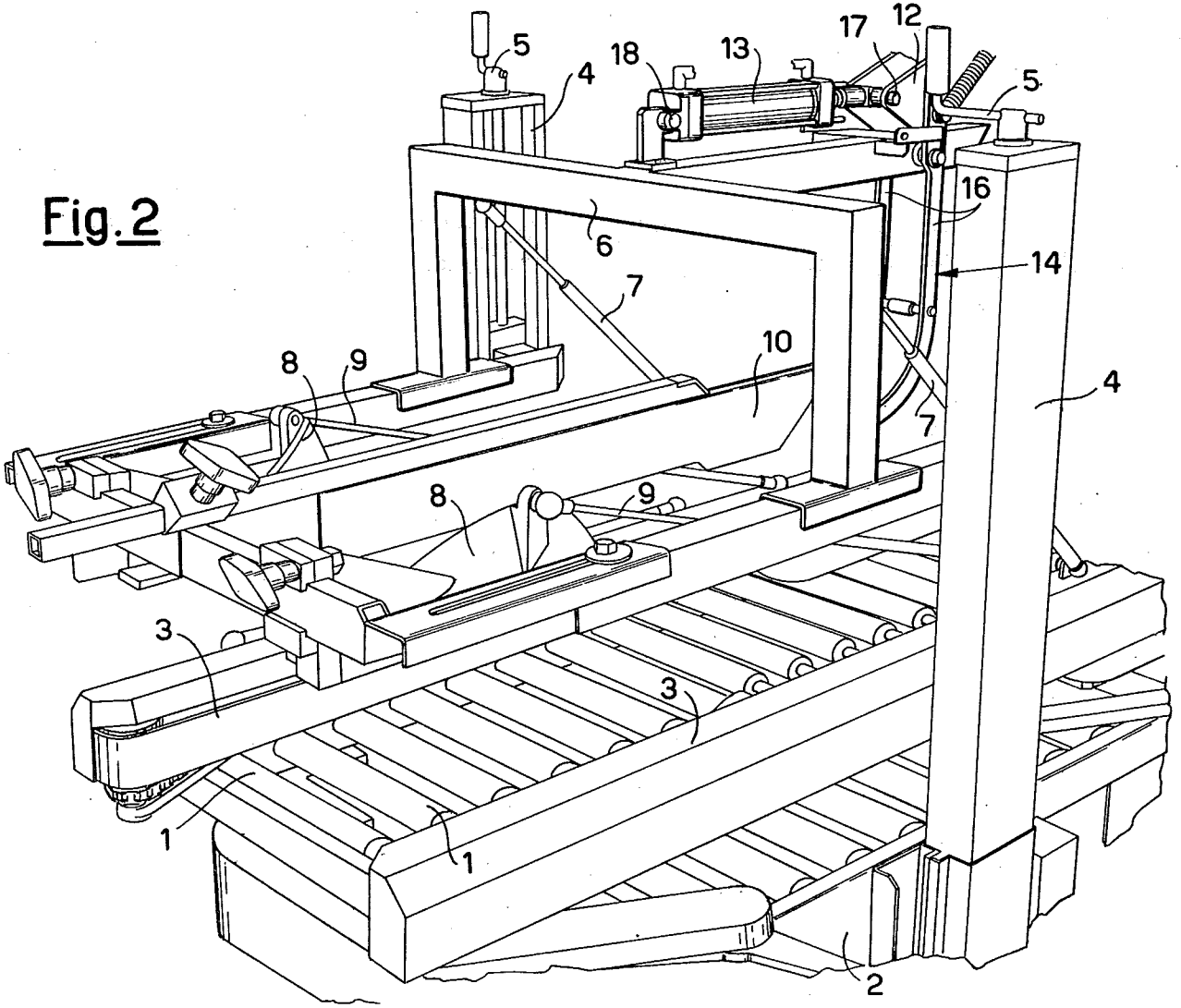
FIG. 2 is a perspective view of the exit part of said machine, where the side flaps of the box are overturned for their closure.

Two side columns 4 support a bridge frame 6 (FIG. 2) at a height which is adjustable (by means of a hand wheel 5 acting on known screw means incorporated in the columns 4), and which is also connected to the conveyor belts 3 by rods 7 with spherical end pins (FIGS. 1 and 2). Said frame supports a pair of stationary lateral guides 8, which can be adjusted laterally and longitudinally, and are shaped to overturn the side flaps of the boxes into their closed position when encountered by them in travelling from the right to the left of FIGS. 1 and 2. Said guides 8 are connected to the conveyor belts 3 by rods 9 with spherical end pins. The frame 6 also supports a central stationary guide 10, which can be adjusted longitudinally, and the purpose of which is to engage with the already overturned end flaps of the boxes to maintain them in their closed position.

An inverted V structure 12 is hinged at 11 to the frame 6 in front of the central stationary guide 10, and is rotated by a pneumatic cylinder 13 (connected at 17 and reacting at 18), and acts as a common rotatable support for a first closure member 14 designed to overturn the front flap of the boxes into its closed position, and for a second closure member 15 designed to overturn the rear flap of the boxes into its closed position, said closure members 14 and 15 being connected to respective front and rear ends of the support 12.

Figure 5:
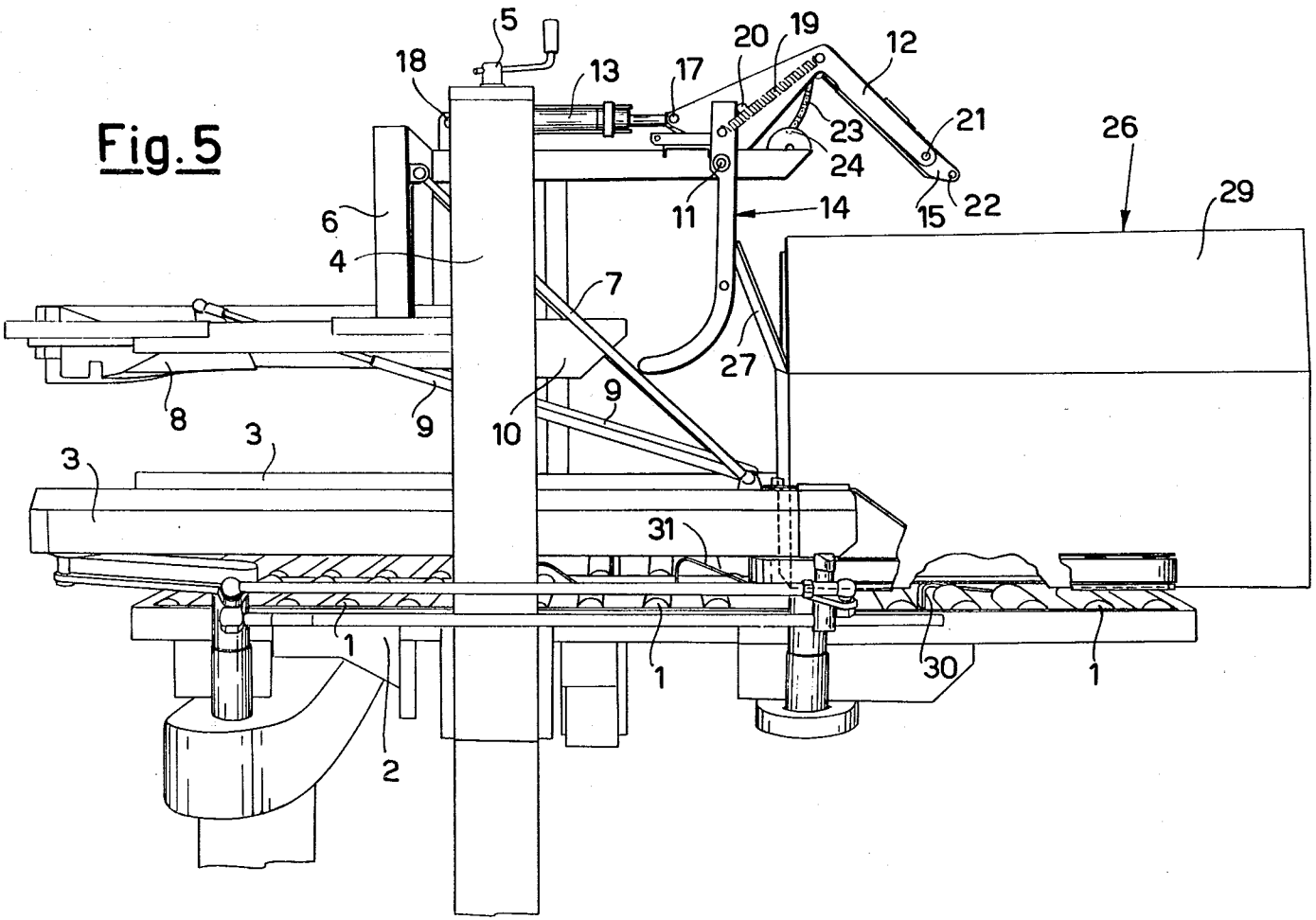
FIGS. 5 to 11 are side views of said machine in the successive operating stages of a closure sequence for the end flaps of a box.
Figure 6:
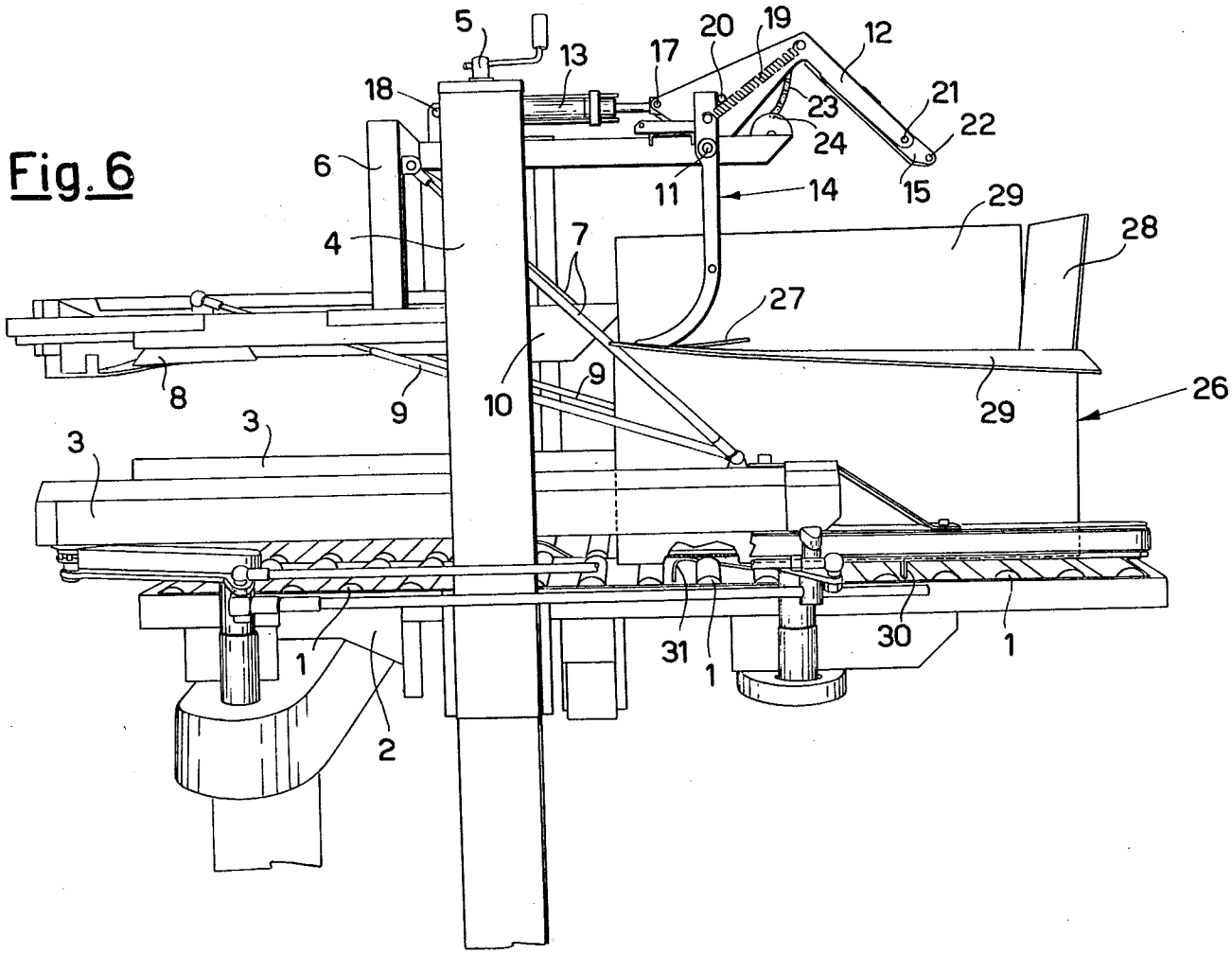

The closure member 14 is constituted by a pair of L arms 16 rigidly connected together, which are pivoted to the rotatable support 12 on the rotational pivot 11 thereof, and are urged by two springs 19 towards an angular position which is defined, relative to the support 12, by a pair of stops 20 fixed to the support 12. The condition is such that when the rotatable support 12 is in the extreme angular position of FIGS. 1 and 3, the closure member 14 is inserted into the path of travel of the open end flaps of the boxes, so as to be able to engage with the front flap to turn it over into its closed position (FIGS. 5 and 6). When the rotatable support 12 is in its other extreme angular position shown in FIG. 6, the closure member 14 is lifted outside said travel path, so as not to constitute an obstacle to the overturning of the rear flap of the boxes into its closed position (FIGS. 8 to 11), as will be explained hereinafter. The articulated joint at 11 between the closure member 14 and support 12 is provided for safety purposes connected with this latter condition of operation, in that it obviates any insertion of the operator's hand between the arms 16 and frame 6.

Figure 3:
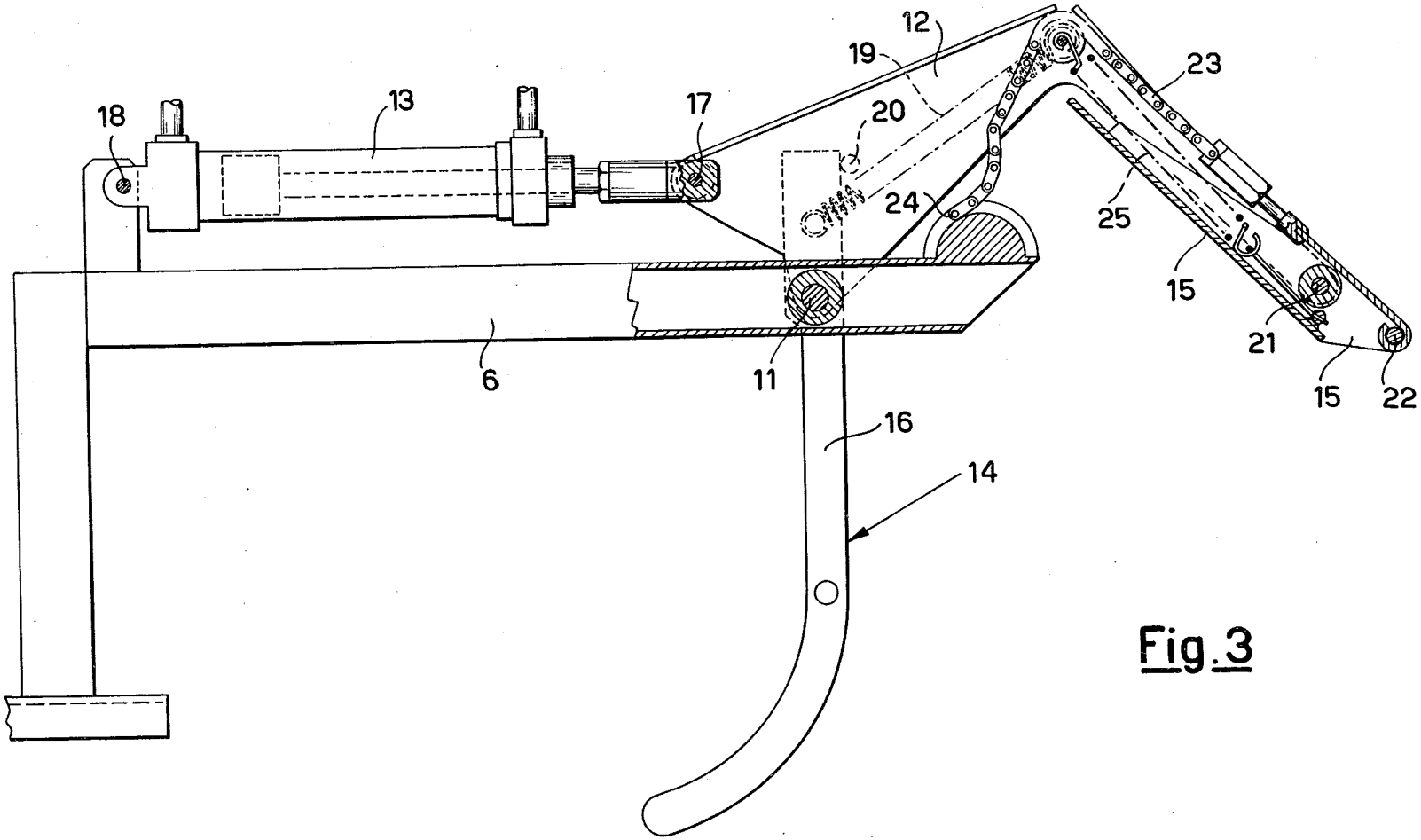
FIGS. 3 and 4 are longitudinal sections through the unit constituted by the two end flap closure members and their rotatable support, the unit being shown in the two angular positions assumed by said rotatable support.
Figure 4:
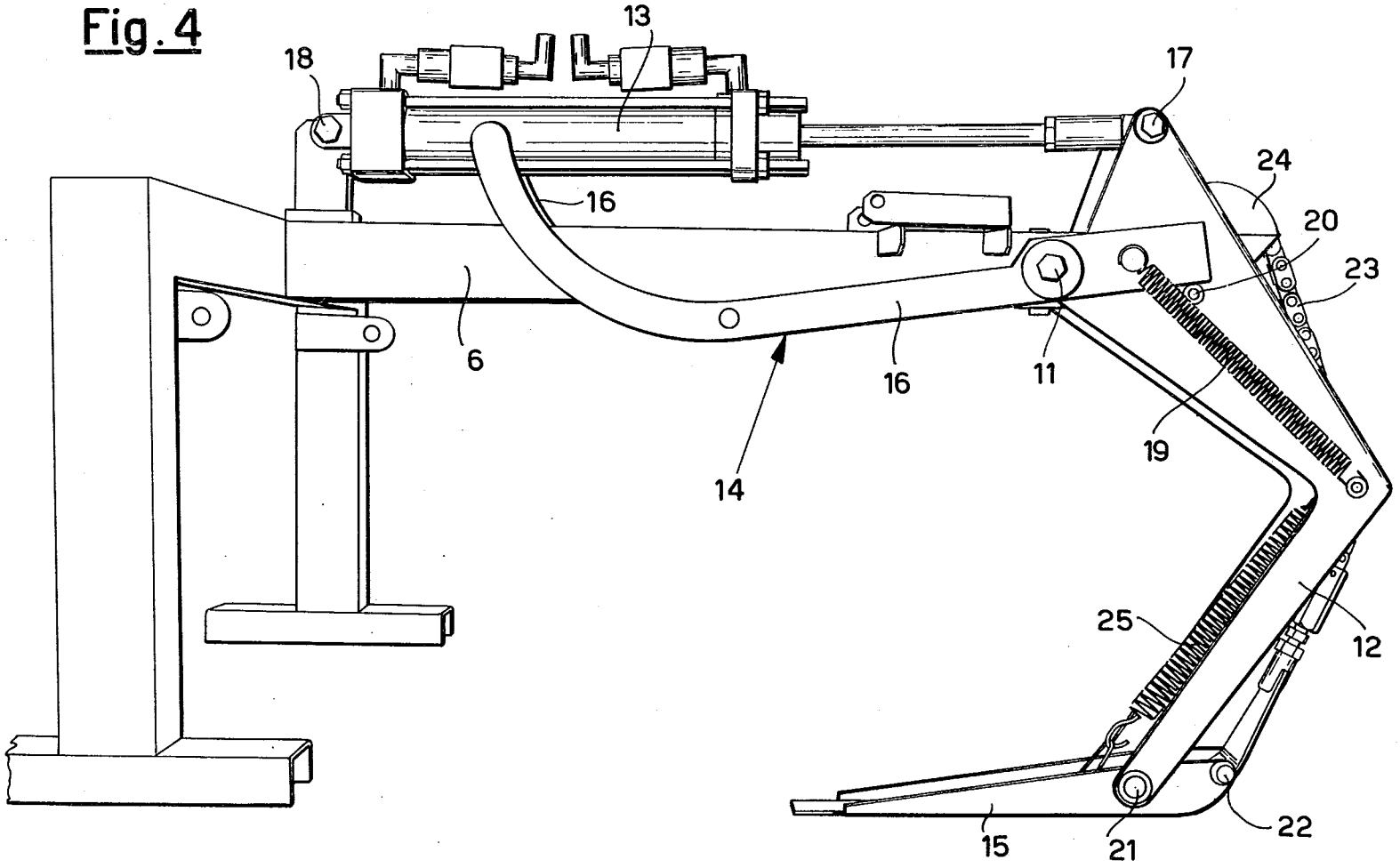

The closure member 15 is constituted by a rotatable arm pivoted at 22 to the rotatable support 12, one end of a chain 23 being connected to 22, and its other end being connected to a fixed point 24. As shown in FIGS. 3 and 4, the length of the chain 23 is chosen such that the chain is not under tension when the rotatable support 12 is in the angular position of FIG. 3, but is under tension when the rotatable support 12 is in the angular position of FIG. 4, so as to cause rotation (opposed resiliently by a spring 25) of the closure member 15 relative to the rotatable support 12. AS also shown in FIGS. 5 to 11, when the rotatable support 12 is in the angular position of FIGS. 1 and 3, the closure member 15 is outside the path of travel of the open end flaps of the boxes (FIGS. 5 to 7), whereas rotation of the rotatable support 12 towards the angular position of FIG. 4 leads to the progressive insertion of the closure member 15 into said path of travel, to engage the rear flap of the boxes from behind, until it has completely turned over into its closed position (FIGS. 8 to 11).

To understand the method of operation of the machine shown in FIGS. 1 to 4, and in particular the two closure members 14 and 15, reference should be made to FIGS. 5 to 11, which also show a parallelepiped box 26 provided with an upper front flap 27, an upper rear flap 28, and upper side flaps 29 (one of which is removed in FIGS. 7 to 11 for clarity of drawing). At the commencement of the operating cycle, the sides of the box are engaged by the conveyor belts 3, which feed the box from right to left (with reference to the FIGURES) on the support surface constituted by the rollers 1. During its travel, the base of the box firstly encounters a first sensor 30 forming part of a very simple central compressed air unit easily constructed by an expert of the art (and therefore neither shown on the drawings nor described in detail), which operates the pneumatic cylinder 13 when the base of the box disengages from the sensor 30 after having engaged with a subsequent sensor 31 shown in FIG. 8, and returns the cylinder 13 to rest when the base of the box disengages from the sensor 31 after disengaging from the sensor 30.

Figure 7:
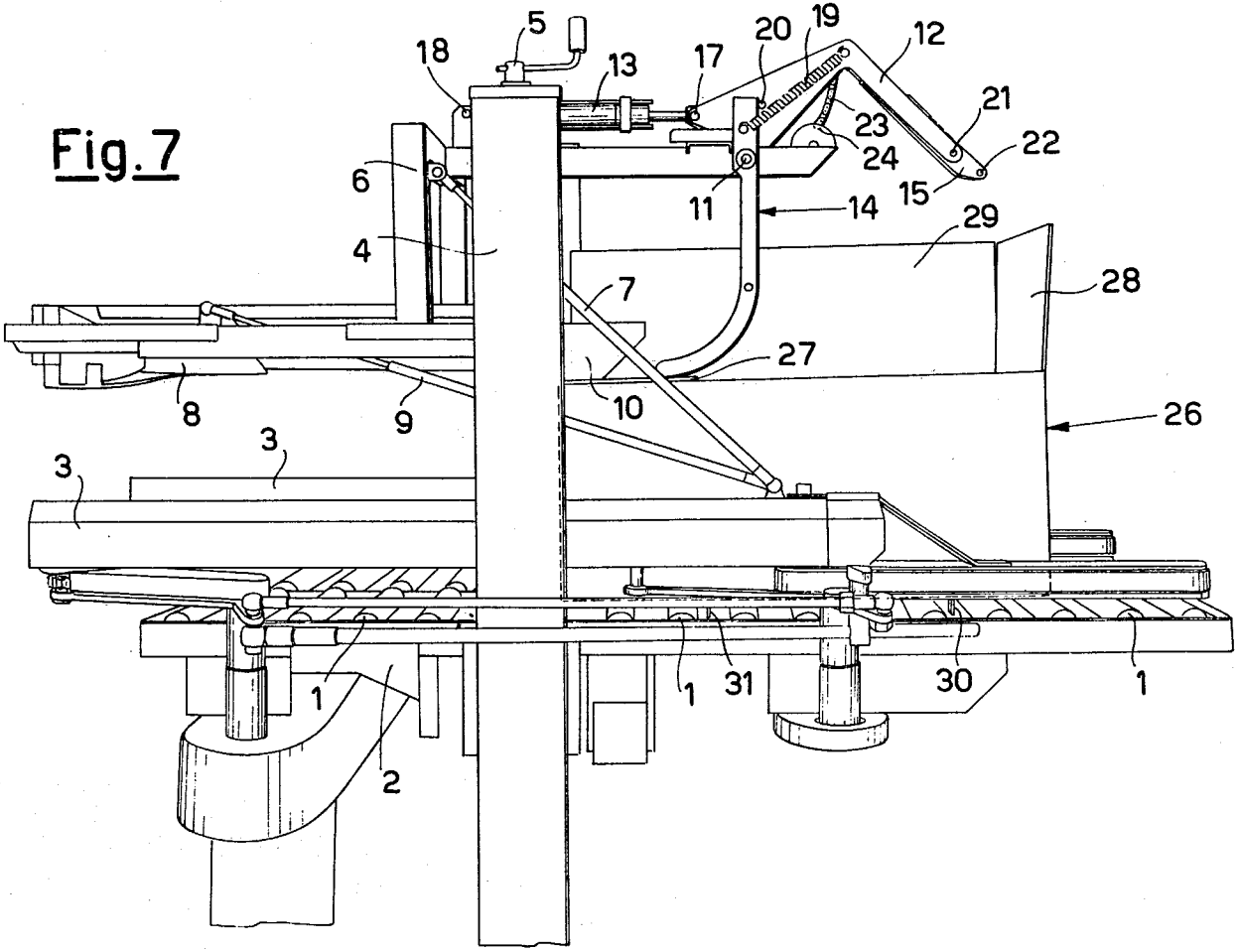
Figure 8:
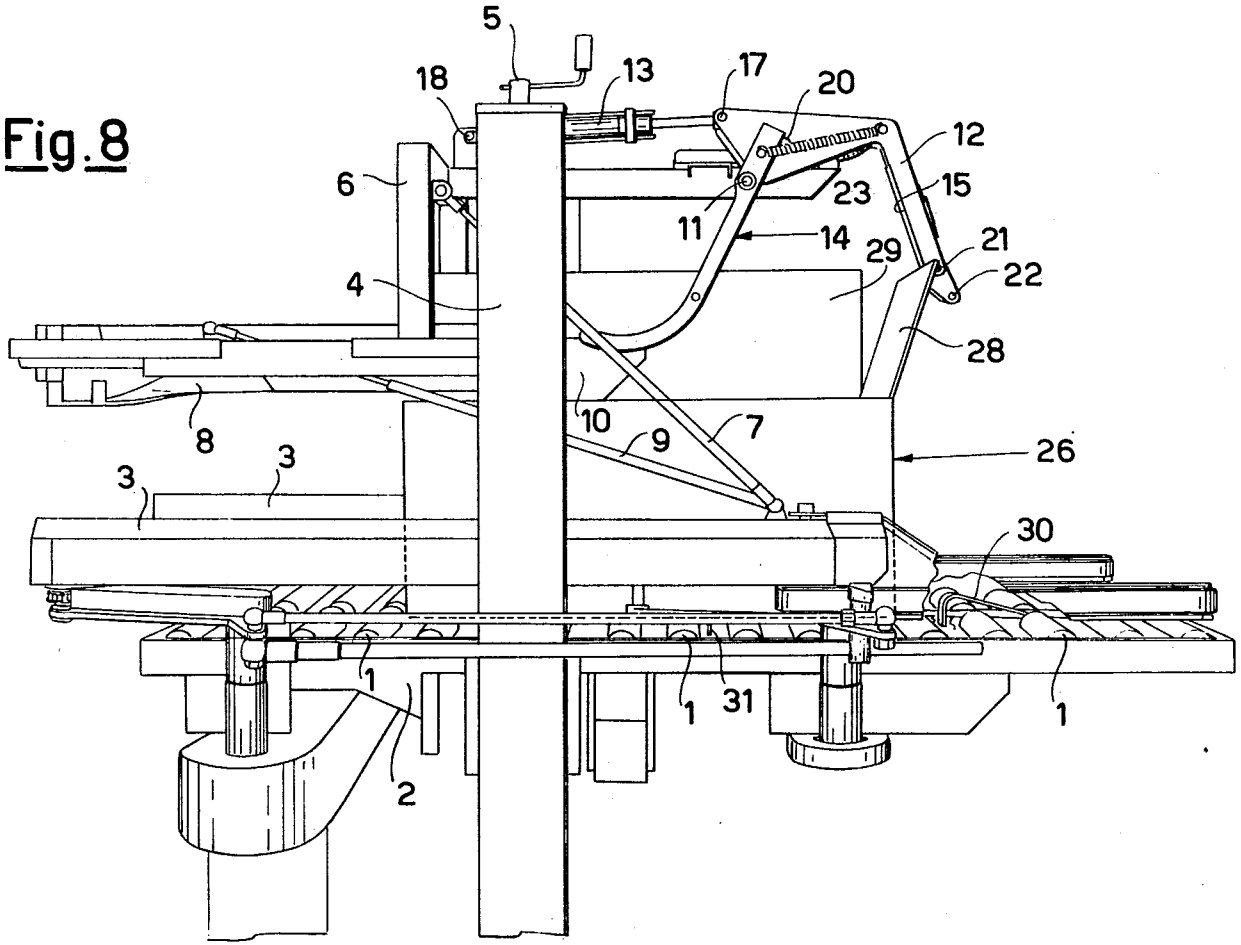
Figure 9:
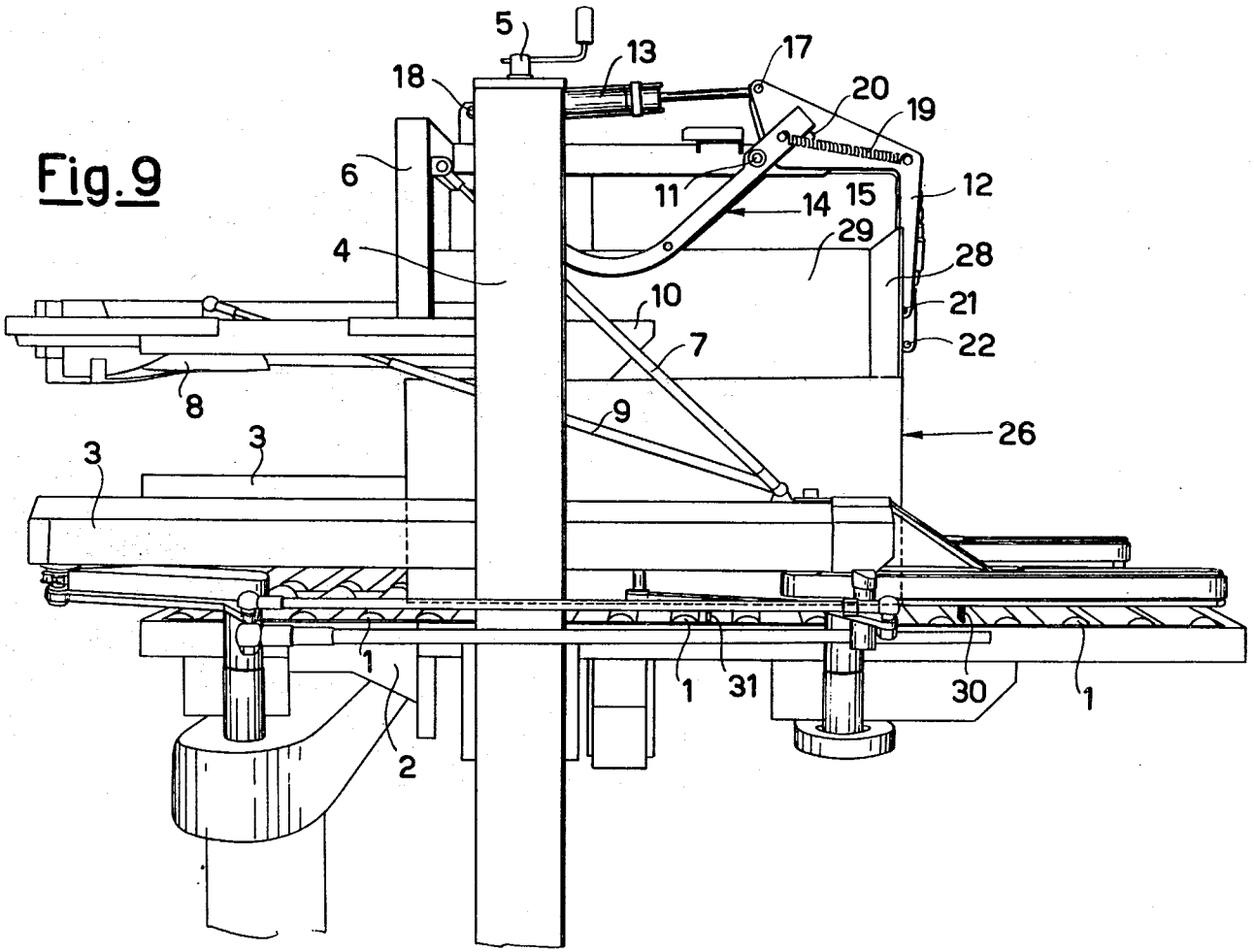
Figure 10:
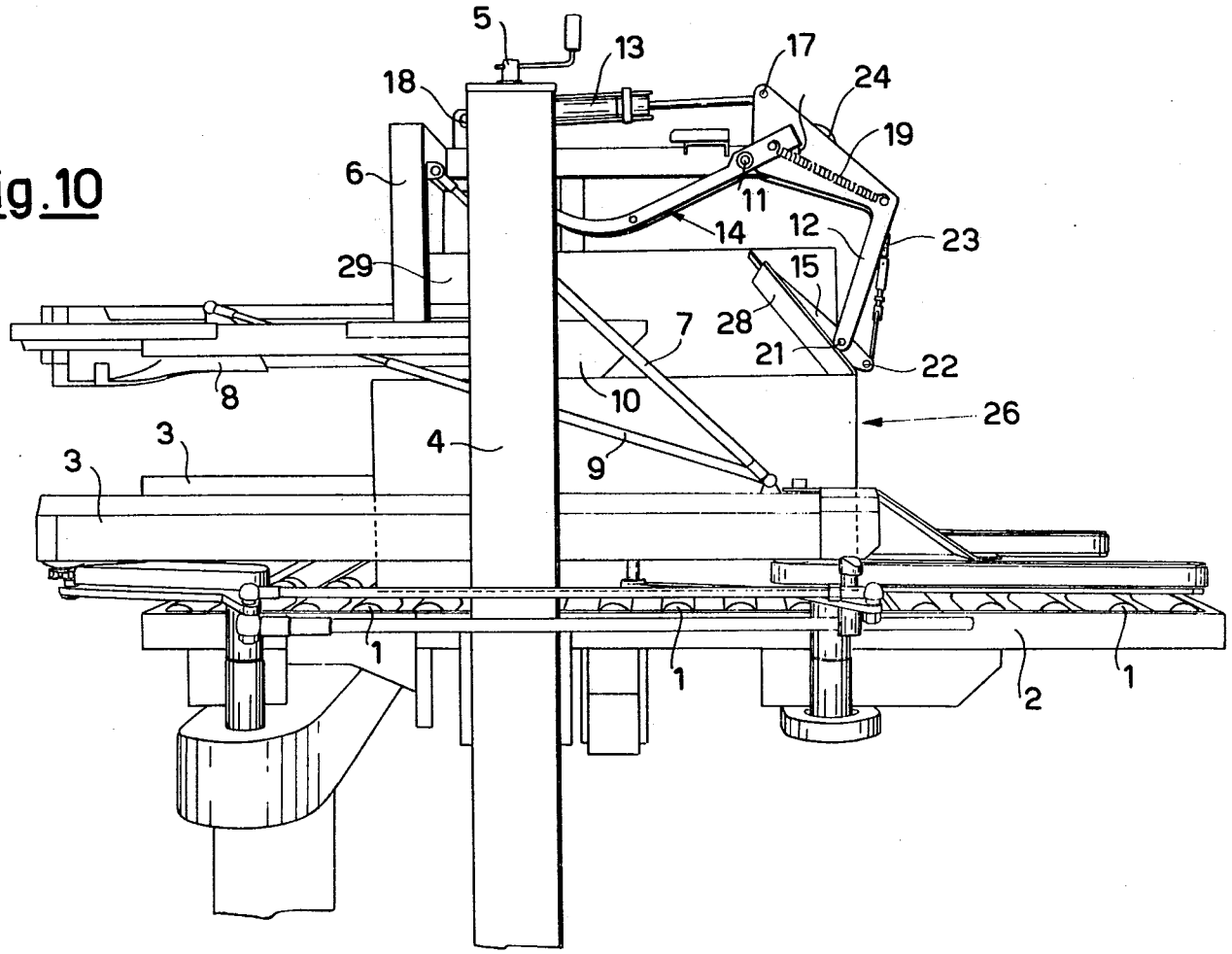
Figure 11:
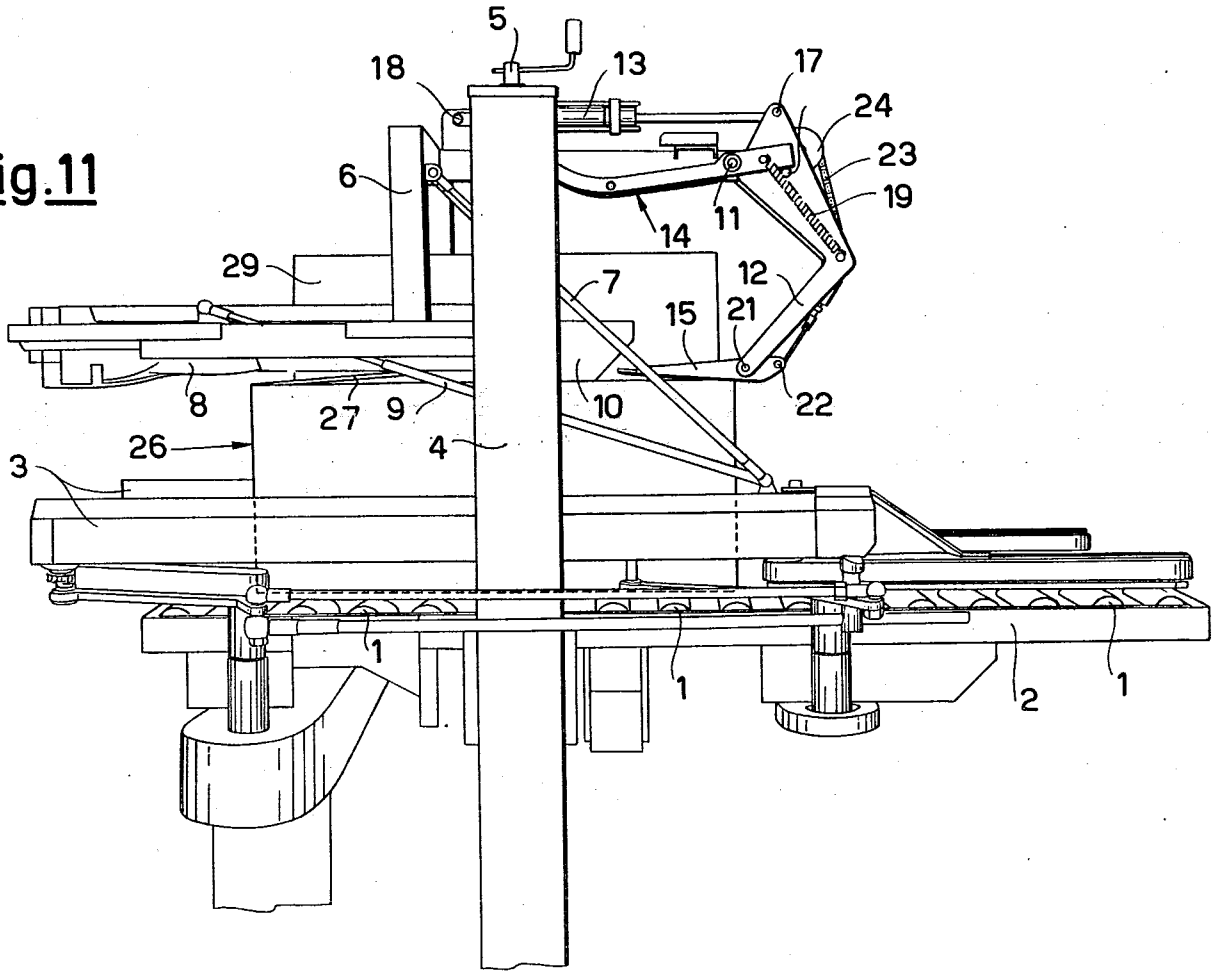

Thus, the initial engagement with the sensor 30 does not cause any change in the position of the cylinder 13 or therefore in the position of the assembly of closure members 14 and 15, the first of which is, and remains, inserted into the path of travel of the open upper flap 27 of the box 26. The engagement which thus occurs between the closure member 14 and front flap 27 (FIG. 5) causes this latter to turn over into its closed position (FIG. 6), where it is retained by the central stationary guide 10 (FIG. 7). During this operation, the closure member 14 does not cause any damage to the flap 27, because of its configuration in the shape of two rigidly connected arms which allows it to make double instead of single contact.

When the base of the box disengages from the first sensor 30 after engaging the second sensor 31 (FIG. 8), the cylinder 13 is extended so as to rotate the rotatable support 12 towards the angular position of FIG. 4. Consequently, the front closure member 14 leaves the path of travel of the rear flap 28 (FIGS. 8 to 11), and at the same time the front closure member 15 rotates, initially rigidly with the rotatable support 12 to engage the rear flap 28 from behind, if necessary displacing it from the outwardly inclined position of FIG. 8 to the substantially vertical position of FIG. 9. The closure member 15 rotates rigidly with the support 12 until, with the support 12 substantially in the position of FIG. 9, the initially slack chain 23 comes into tension between the fixed connection point 24 and the mobile connection point 22. This tensioning compels the closure member 15 to rotate about its pivot 21 against the action of the spring 25, so firstly arranging itself in the position of FIG. 10 and then in the position of FIG. 11, and consequently turning the rear flap 28 over into its closed position.

As the overturned rear flap engages under the central stationary guide 10, the base of the box 25 disengages from the sensor 31, which causes the cylinder 13 together with the two closure members 14 and 15 and the relative rotatable support 12 to return to the rest position.

The side flaps 29 are then engaged in known manner by the shaped lateral guides 8, which turn them over into their closed position on top of the overturned end flaps 27 and 28.

Referring now to FIGS. 12 to 16, these show a preferred improved embodiment of the described machine, in which a pair of arms are added to keep the side flaps of the boxes divaricated after the front flap is closed but before the rear flap is closed.

In a like manner to that heretofore described, a bridge frame 6, which is adjustable in height relative to the support and feed surface for the boxes, rotatably supports at 11 an inverted V structure 12, which is rotated by a pneumatic cylinder 13 (connected at 17 and reacting at 18), and acts as a common rotatable support for a first closure member 14 designed to overturn the front flap of the boxes into its closed position, and for a second closure member 15 designed to overturn the rear flap of the boxes into its closed position, said closure members 14 and 15 being connected to the front and rear end respectively of the support 12.

The closure member 14 is constituted by a pair of L arms 16 rigidly connected together, which are pivoted to the rotatable support 12 on the rotational pivot 11 of this latter, and are urged by two springs 19 towards an angular position defined, relative to the support 12, by a pair of stops 20 fixed to the support 12. The condition is such that when the rotatable support 12 is in the extreme angular position of FIGS. 12 to 14, the closure member 14 is inserted into the path of travel of the open end flaps of the boxes, so as to be able to engage with the front flap to overturn it into its closed position. When the rotatable support 12 is in its other extreme angular position shown in FIG. 16, the closure member 14 is raised outside said path of travel, so as not to constitute an obstacle to the overturning of the rear flap of the boxes into its closed position (FIGS. 15 and 16), as will be explained hereinafter.

Two side arms 51 extend to the two sides of the arms 16 from the front closure member 14, and diverge in the direction of travel of the boxes by a predetermined angle which can be varied by adjusting the normally locked articulated joints 52 which connect them to support forks 53 which are adjustably rotatable about their axis to allow corresponding adjustment of the inclination of the arms 51 to the horizontal. The amount of divergence of said arms 51 is adjusted such that when they engage the side flaps of a box from the inside, they are able to keep them slightly divaricated until the front closure member 14 is in the position of FIGS. 12 to 14. The inclination of the arms 51 to the horizontal is chosen in accordance with the height of the boxes, and the initial position of the rear flap, as will be explained hereinafter.

Figure 13:
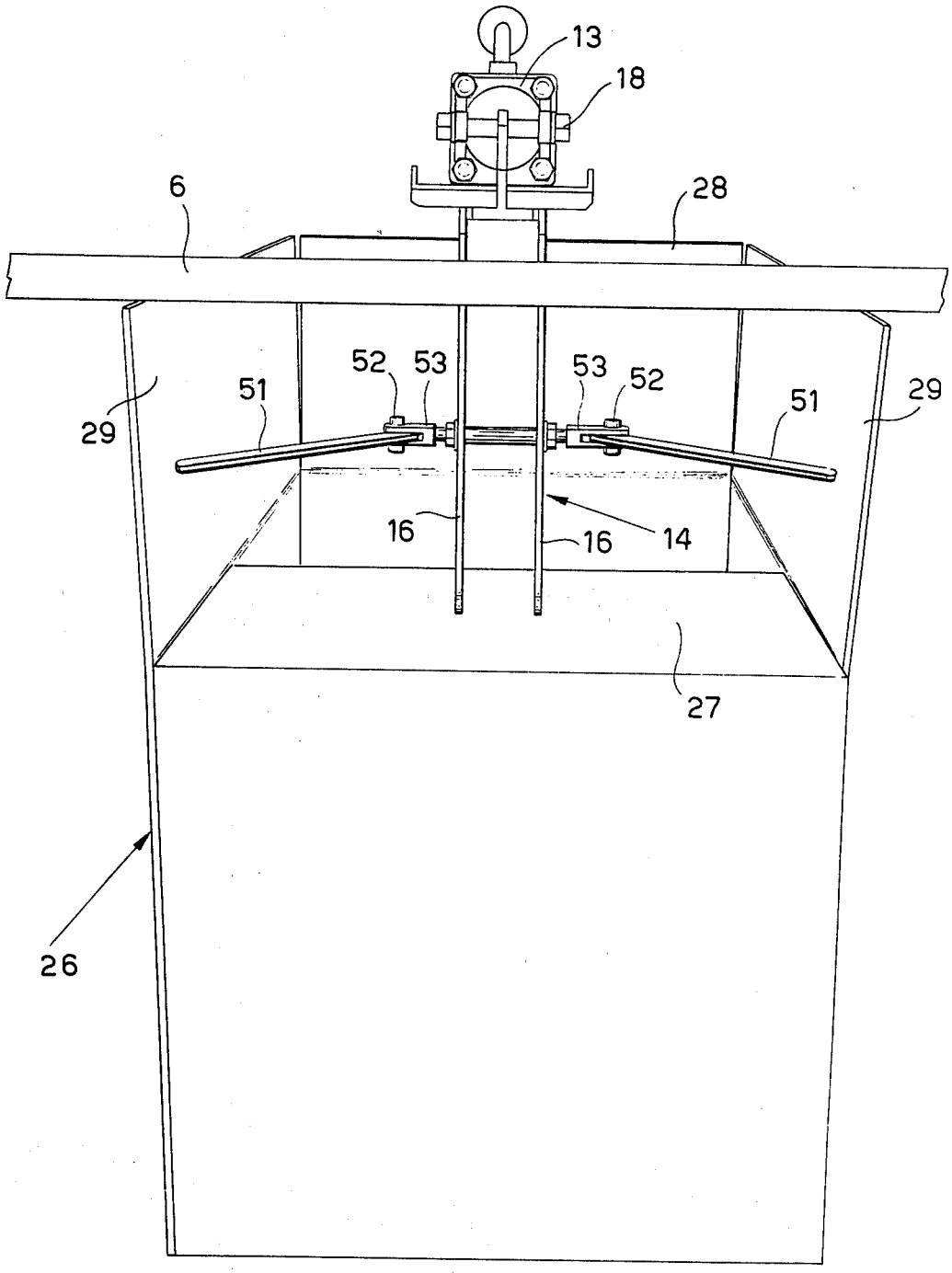
FIG. 13 shows said unit in the same position, but in frontal view.

The closure member 15 is constituted by a rotatable arm pivoted at 21 to the rotatable support 12, and to which one end of a chain 23 is connected at 22, its other end being connected to a fixed point 24. As shown in FIGS. 13 and 16, the length of the chain 25 is chosen such that the chain is not under tension when the rotatable support 12 is in the angular position of FIG. 13, but is under tension when the rotatable support 12 is in the angular position of FIG. 16, to cause rotation (resiliently opposed by a spring 25) of the closure member 15 relative to the rotatable support 12. As shown, when the rotatable support 12 is in the angular position of FIGS. 13 and 14, the closure member 15 is outside the path of travel of the open end flaps of the boxes, whereas when the rotatable support 12 is rotated towards the angular position of FIG. 16, the closure member 15 is progressively inserted into said path of travel to engage the rear flap of the boxes from behind (FIG. 15) until it is completely overturned into its closed position (FIG. 16).

Figure 12:
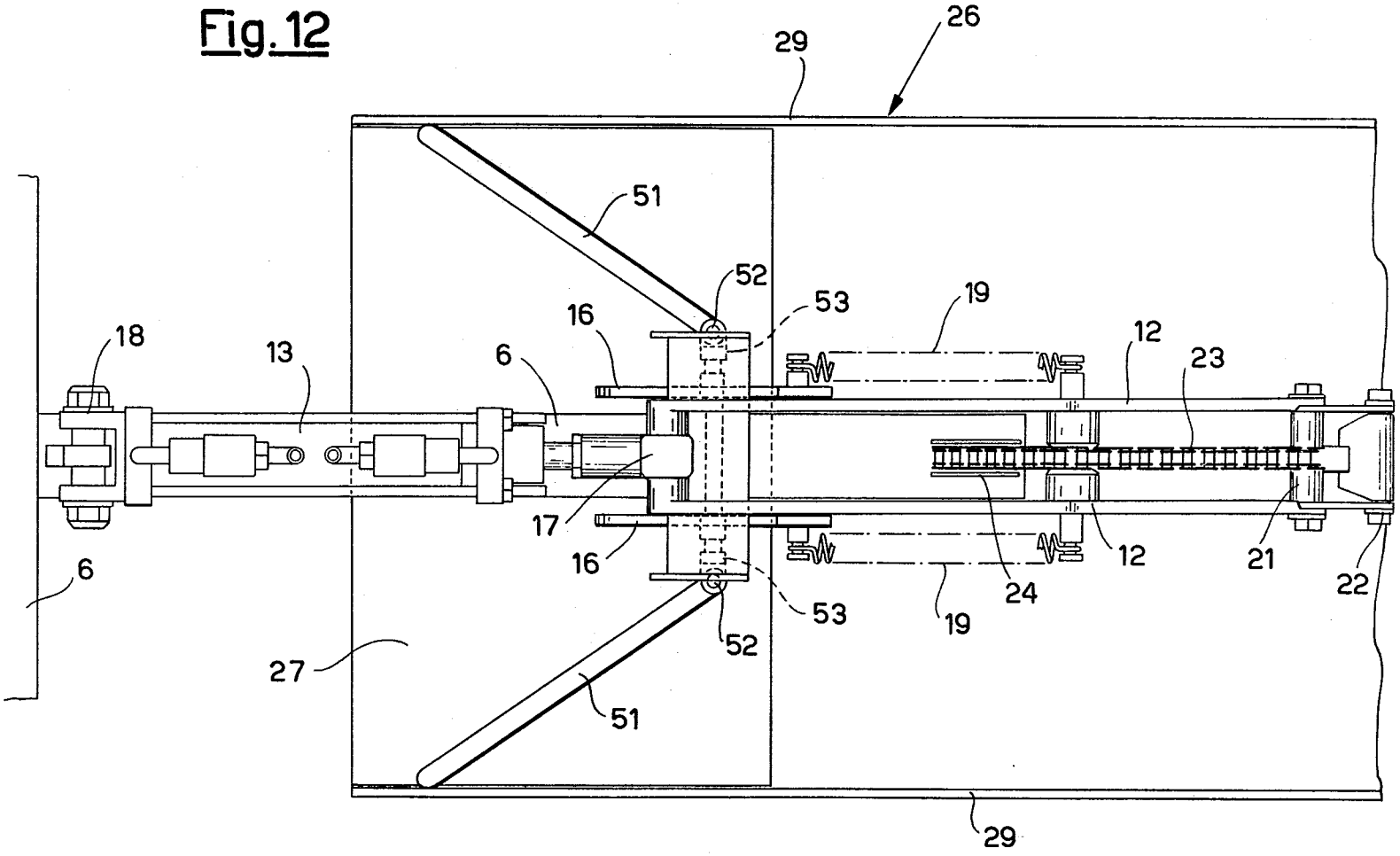
FIG. 12 is a plan view from above of the end flap closure unit, shown in the closure position for the front flap of a box, and showing the two added arms for divaricating the side flaps according to a preferred improvement of the machine according to the invention.
Figure 14:
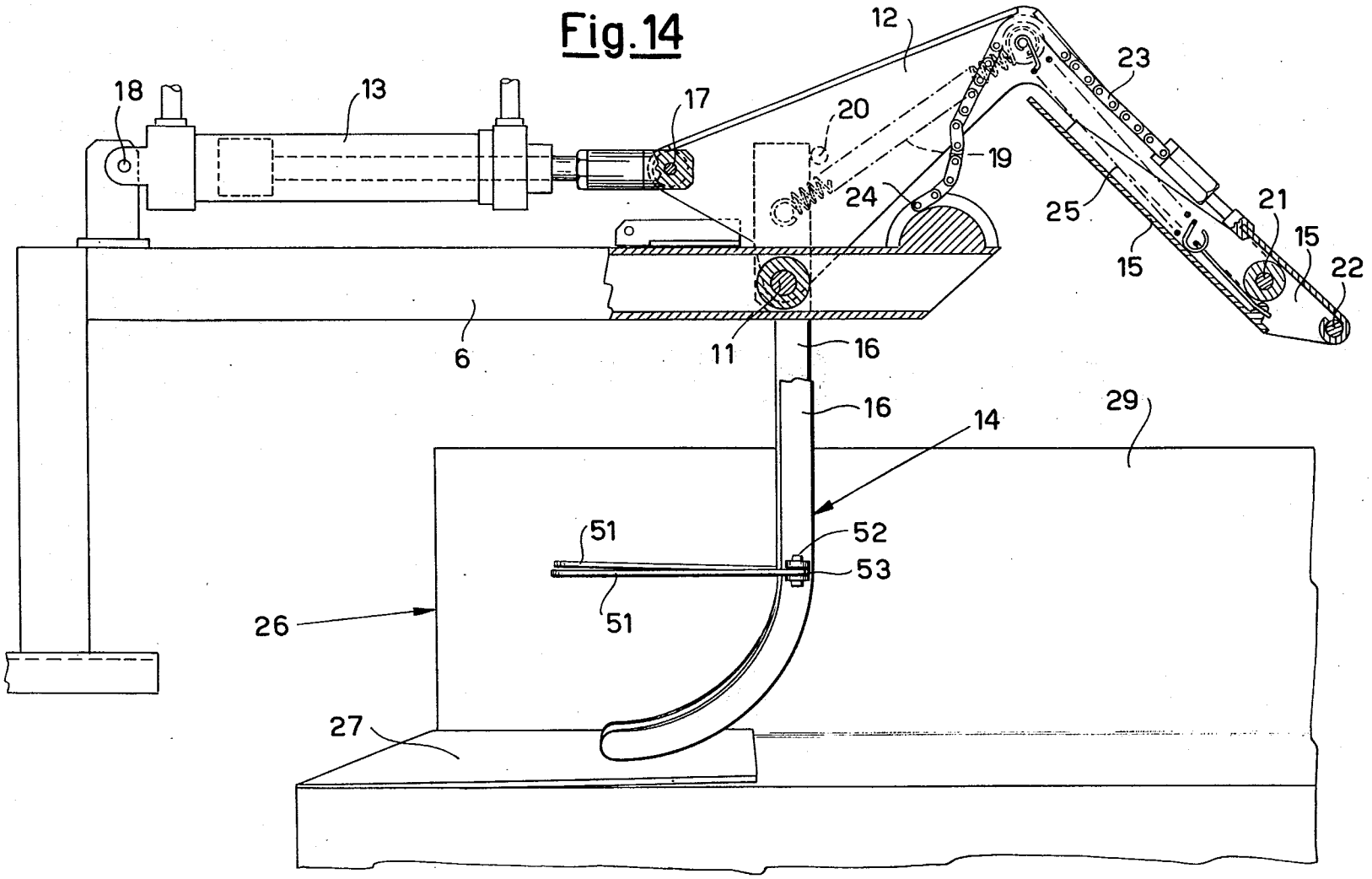
FIG. 14 shows said unit in the same position, but in partly sectional side view.

When in operation, which is analogous to that described for the machine of FIGS. 1 to 11, a parallelepiped box 26 provided with an upper front flap 27, an upper rear flap 28 and upper side flaps 29 is fed along the support surface of the machine of which the unit forms part, while the rotatable support 12 and thus the two closure members 14 and 15 of the closure unit for the end flaps are in the operating position shown in FIGS. 12 to 14, so that the front closure member 14 is and remains inserted into the path of travel of the open front flap 27 of the box 26. The engagement which thus takes place between the closure member 14 and front flap 27 causes this latter to be turned over into its closed position (FIGS. 12, 13 and 14), where it is then held by the central stationary guide 10 (not shown in FIGS. 12 to 16).

While the front closure member 14 closes the front flap 27, the two lateral diverging arms 51 become inserted between the two side flaps 29, forcing them to maintain their slightly divaricated position, which is shown in FIG. 13.

As the box continues on its travel, a suitable sensor sensitive to the box position (such as the sensor 30 of FIG. 8) causes the cylinder 13 to extend so as to rotate the rotatable support 12 towards the angular position of FIG. 16. Consequently, the front closure member 14 progressively emerges from the path of travel of the rear flap 28, and at the same time the rear closure member 15 rotates, initially rigidly with the rotatable support 12 to engage the rear flap 28 from behind, so moving it if necessary from an outwardly inclined position to the substantially vertical position of FIG. 15. The closure member 15 rotates rigidly with the support 12 until the initially slack chain 23 comes into tension between the fixed connection point 24 and the mobile connection point 22. This tension compels the closure member 15 to rotate about its pivot 21 against the action of the spring 25, so becoming disposed in the position of FIG. 16 and consequently turning the rear flap 28 over into its closed position.

Figure 15:
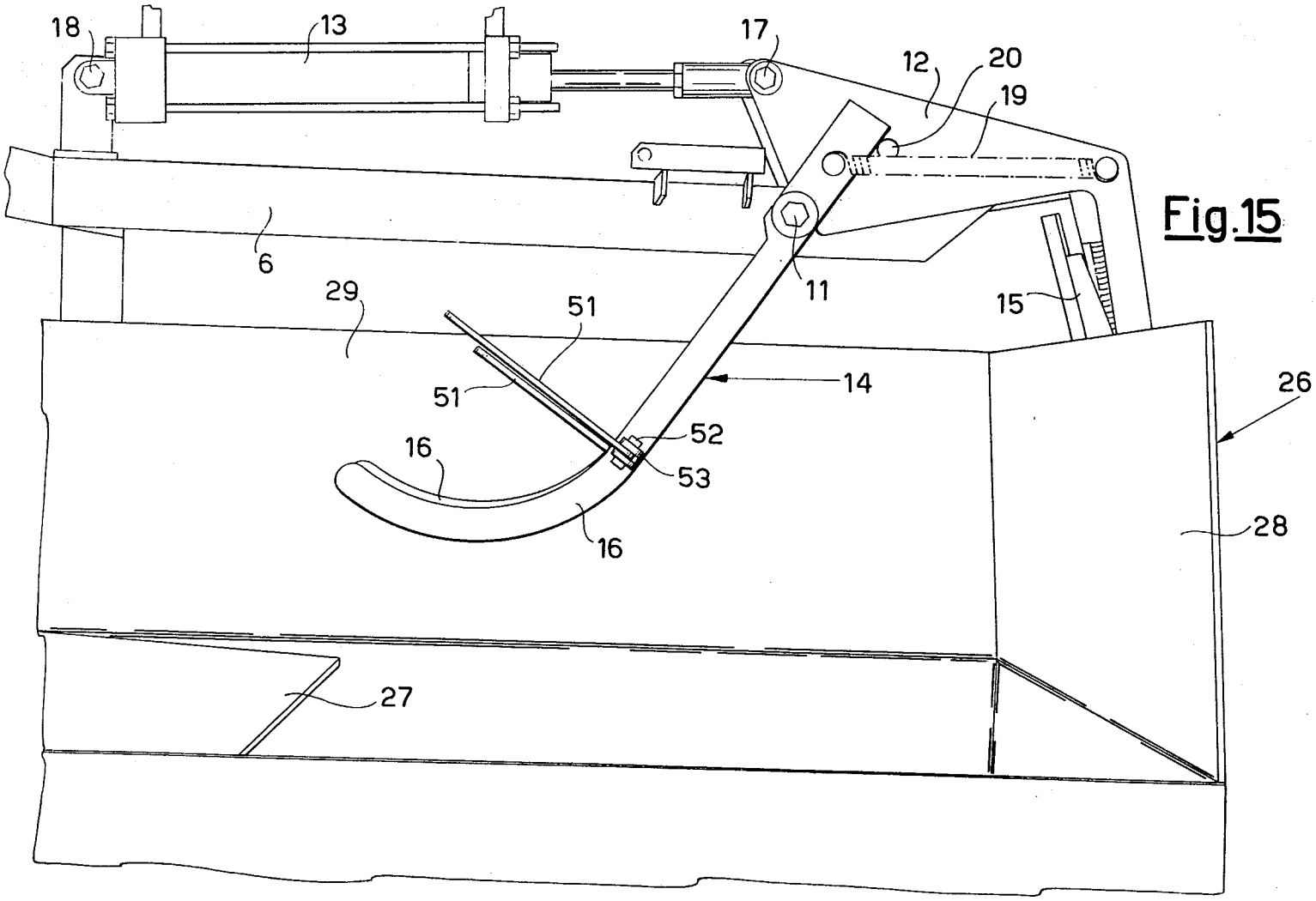
FIG. 15 shows said unit in side view, but in a position in which the two added side arms are closed to releasing the side flaps.
Figure 16:
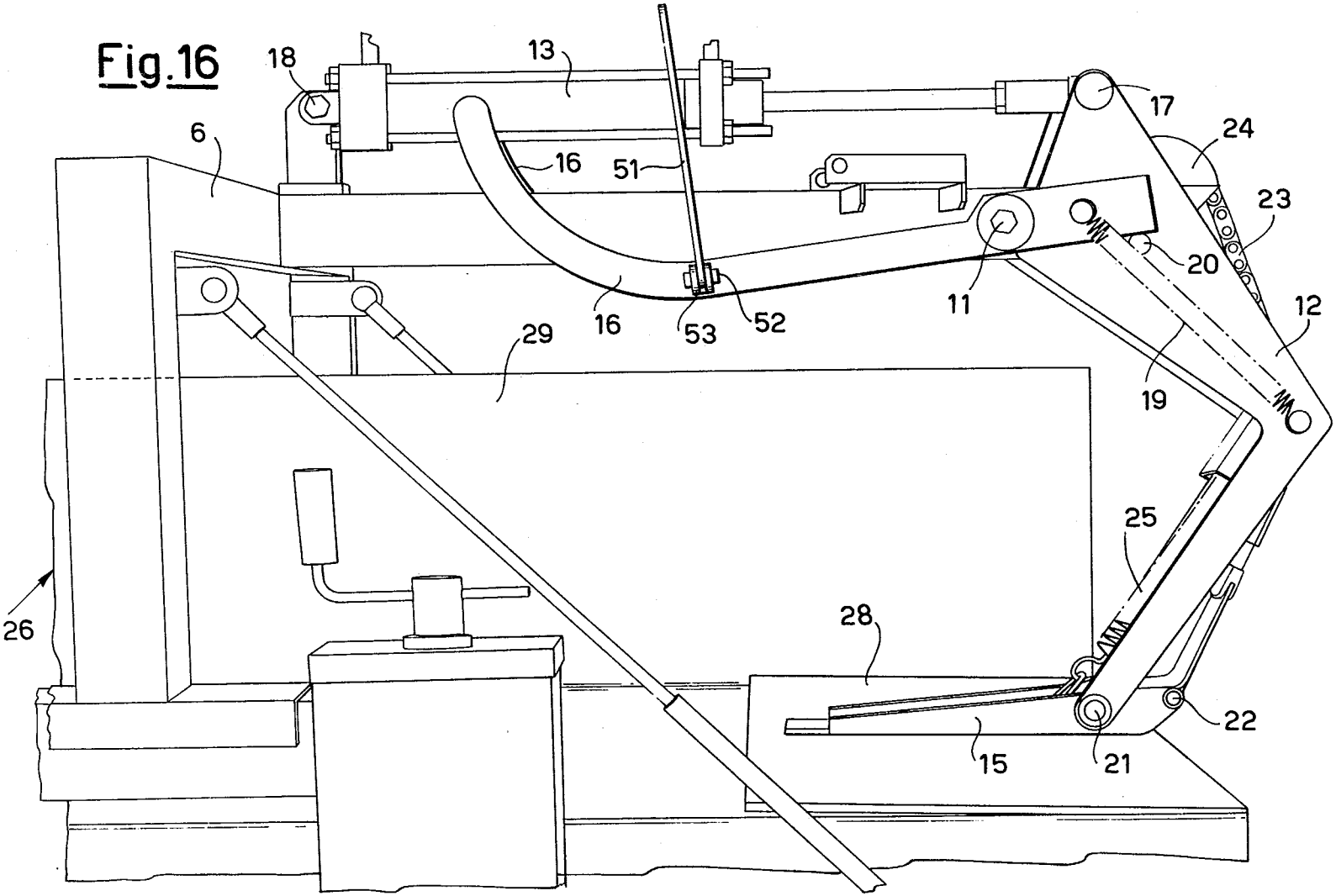
FIG. 16 shows said unit in side view, but in the closure position for the rear flap of the box.

As can be seen from FIGS. 15 and 16, the diverging lateral arms 51 abandon the side flaps 29 only after the closure member 15 has inclined the rear flap 28 towards the interior of the box, to attain its closed position. The side flaps 29 are therefore unable to create an obstacle to the closure of the rear flap.

It should be noted that the inclination of the arms 51 about the axes of the forks 53 is precisely adjusted in accordance with the time necessary for the closure member 15 to close the rear flap. This therefore depends on the angle of opening of the rear flap.

The side flaps 29 are then engaged in known manner by the shaped lateral guides 8 (not shown in FIGS. 12 to 16), which turn them over into their closed position on to the overturned end flaps 27 and 28.

What I claim is:

1. A machine for closing the upper flaps of a parallelepiped box, comprising a support surface for the boxes, means for feeding the boxes along said support surface, and, disposed above said support surface, a first closure member for momentarily engaging with the front end flap of the boxes to turn it over into its closed position, a second closure member for momentarily engaging with the rear end flap of the boxes to turn it over into its closed position, and a guide situated at a predetermined height above said support surface to engage with said overturned box flaps and retain them in their closed position after their disengagement from said closure members, wherein said first and second closure members are constituted by arms carried by respective front and rear ends of a rotatable support, which is rotatable on command from a first angular position for closing the front flap, to a second angular position for closing the rear flap, whereby in said first position said first closure member is inserted into the path of travel of the open end flaps of the boxes so that it is encountered by said front flap and is thus turned over into its closed position, said second closure member being outside said path, in said second position said first closure member is outside said path and said second closure member is inserted into said path to engage the open rear flap of the boxes from behind, means being provided to respond to the displacement of said rotatable support from said first to said second angular position to cause said second closure member to rotate relative to said rotatable support, on termination of said displacement, until in a substantially horizontal position for turning said rear flap over into its closed position, wherein said rotatable support is substantially in the form of an inverted V, and said means for rotating said second closure member are constituted by a flexible connection means which straddles said rotatable support and acts between a fixed connection point and said second closure member, the length of said flexible means being chosen such as to enable it ot be put under tension by the yeildably opposed rotation of said second closure member only on termination of the movement of the rotatable support from said first to said second angular position.

2. A machine as claimed in claim 1, wherein said first closure member is pivoted to said rotatable support, and resilient means are provided for retaining said first closure member in a predetermined angular position relative to said rotatable support.

3. A machine [as claimed in claim 1] for closing the upper flaps of a parallelepiped box, comprising a support surface for the boxes, means for feeding the boxes along said support surface, and, disposed above said support surface, a first closure member for momentarily engaging with the front end flap of the boxes to turn it over into its closed position, a second closure member for momentarily engaging with the rear end flap of the boxes to turn it over into its closed position, and a guide situated at a predetermined height above said support surface to engage with said overturned box flaps and retain them in their closed position after their disengagement from said closure members, wherein said first and second closure members are constituted by arms carried by respective front and rear ends of a rotatable support, which is rotatable on command from a first angular position for closing the front flap, to a second angular position for closing the rear flap, whereby in said first position said first closure member is inserted into the path of travel of the open end flaps of the boxes so that it is encountered by said front flap and is thus turned over into its closed position, said second closure member being outside said path, in said second position said first closure member is outside said path and said second closure member is inserted into said path to engage the open rear flap of the boxes from behind, means being provided to respond to the displacement of said rotatable support from said first to said second angular position to cause said second closure member to rotate relative to said rotatable support, on termination of said displacement, until in a substantially horizontal position for turning said rear flap over into its closed position, also comprising shaped lateral guides disposed to the sides of said guide of predetermined height, to cause the progressive overturning of the side flaps into their closed position above the overturned end flaps, wherein from said first closure member there extends a pair of rigidly connected lateral arms which diverge in an adjustable manner in the direction of travel of the boxes along said support surface, and are disposed at such a height as to engage the side flaps of the box from the inside, to maintain them in at least a slightly divaricated position until the action of said second closure member has compelled the rear flap to incline towards the inside of the box, and beyond its initial position.

4. A machine [as claimed in claim 1] for closing the upper flaps of a parallelepiped box, comprising a support surface for the boxes, means for feeding the boxes along said support surface, and, disposed above said support surface, a first closure member for momentarily engaging with the front end flap of the boxes to turn it over into its closed position, a second closure member for momentarily engaging with the rear end flap of the boxes to turn it over into its closed position, and a guide situated at a predetermined height above said support surface to engage with said overturned box flaps and retain them in their closed position after their disengagement from said closure members, wherein said first and second closure members are constituted by arms carried by respective front and rear ends of a rotatable support, which is rotatable on command from a first angular position for closing the front flap, to a second angular position for closing the rear flap, whereby in said first position said first closure member is inserted into the path of travel of the open end flaps of the boxes so that it is encountered by said front flap and is thus turned over into its closed position, said second closure member being outside said path, in said second position said first closure member is outside said path and said second closure member is inserted into said path to engage the open rear flap of the boxes from behind, means being provided to respond to the displacement of said rotatable support from said first to said second angular position to cause said second closure member to rotate relative to said rotatable support, on termination of said displacement, until in a substantially horizontal position for turning said rear flap over into its closed position, wherein said arms are connected in an articulated manner, along substantially vertical axes, to respective supports which are adjustably rotatable about respective substantially horizontal axes.

* * * * *